US009466245B2

(12) United States Patent
Ma

(10) Patent No.: US 9,466,245 B2
(45) Date of Patent: Oct. 11, 2016

(54) PIXEL DRIVING CIRCUIT AND DRIVING METHOD THEREOF, DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 107 days.

(21) Appl. No.: 14/445,100

(22) Filed: Jul. 29, 2014

(65) Prior Publication Data

US 2015/0269890 A1 Sep. 24, 2015

(30) Foreign Application Priority Data

Mar. 24, 2014 (CN) ..... 2014 1 0110858

(51) Int. Cl.

| | |
|---|---|
| ***F02P 17/00*** | (2006.01) |
| ***G09G 3/32*** | (2016.01) |
| *F02P 17/12* | (2006.01) |
| *F23Q 23/00* | (2006.01) |

(52) U.S. Cl.

CPC ..... *G09G 3/3291* (2013.01); *G09G 3/3233* (2013.01); *F02P 17/00* (2013.01); *F02P 17/12* (2013.01); *F23Q 23/00* (2013.01); *G09G 2300/0819* (2013.01); *G09G 2300/0842* (2013.01); *G09G 2300/0861* (2013.01); *G09G 2310/0251* (2013.01); *G09G 2310/061* (2013.01); *G09G 2320/02* (2013.01)

(58) Field of Classification Search

CPC .... F02P 17/12; F02P 2017/125; F02P 17/00; G01R 31/007; G01R 31/34; G01R 19/0092; G01R 29/02; F23Q 23/00; H01T 13/58; H01T 13/60

USPC ..... 324/378–402

See application file for complete search history.

(56) References Cited

U.S. PATENT DOCUMENTS

| | | | | |
|---|---|---|---|---|
| 2002/0001038 | A1* | 1/2002 | Lee | H04N 5/3575 348/308 |
| 2007/0195920 | A1* | 8/2007 | Tobita | G11C 19/28 377/64 |
| 2008/0036725 | A1* | 2/2008 | Lee | G09G 3/3677 345/100 |
| 2014/0093028 | A1* | 4/2014 | Wu | G11C 19/28 377/64 |
| 2015/0243237 | A1* | 8/2015 | Li | G09G 3/00 345/100 |

FOREIGN PATENT DOCUMENTS

| | | | |
|---|---|---|---|
| CN | 1776797 | A | 5/2006 |
| CN | 103578426 | A | 2/2014 |
| JP | 2011191449 | A | 9/2011 |

OTHER PUBLICATIONS

1st Office Action issued in Chinese application No. 201410110858.3 issued Jul. 31, 2015.

* cited by examiner

*Primary Examiner* — Huy Q Phan
*Assistant Examiner* — Raul Rios Russo
(74) *Attorney, Agent, or Firm* — Nath, Goldberg & Meyer; Joshua B. Goldberg

(57) ABSTRACT

The present invention provides a pixel driving circuit and a driving method thereof, and a display apparatus, which can raise starting point for writing a data, ensure time for writing the data, and avoid distortion of the written data. The pixel driving circuit comprises a reset module, a data write module, an output module and a pre-charging module, wherein during a period after a reset stage and before inputting of a row driving signal, the pre-charging module performs a step of pre-charging.

10 Claims, 4 Drawing Sheets

PIXEL DRIVING CIRCUIT AND DRIVING METHOD THEREOF, DISPLAY APPARATUS

FIELD OF THE INVENTION

The present invention relates to a field of display driving circuit technology, and in particular, relates to a pixel driving circuit and a driving method thereof, and a display apparatus.

BACKGROUND OF THE INVENTION

An organic light emitting diode (OLED) is a current-mode light emitting device. Due to advantages such as spontaneous light emitting, fast response, wide-viewing angle and ability to be fabricated on a flexible substrate, the OLED is more frequently used in a field of high performance display. OLEDs can be classified into two kinds of passive matrix driving OLEDs (PMOLEDs) and active matrix driving OLEDs (AMOLEDs) based on driving modes thereof. With respect to traditional PMOLEDs, with increasing of size of a display apparatus, a driving time of a single pixel is usually required to be reduced, thus a transient current flowing through a PMOLED is required to be increased, and thereby power consumption will be increased significantly. In contrast, with respect to AMOLEDs, as a current is inputted into each AMOLED by progressive scanning of a thin film transistor (TFT) switching circuit, existing problems can be well solved.

In existing AMOLED products, in order to reduce cost for manufacturing a driving integrated circuit (IC), a demultiplexer (DEMUX) is usually formed on a glass substrate. In this way, in a data transmission, a data signal is separated into red, green and blue (RGB) signals through the DEMUX, and the red, green and blue signals are respectively transmitted to R, G and B data lines on a back plate, and are stored by capacitors on the R, G and B data lines, so that when a gate scanning signal is inputted, the RGB signals are transmitted into RGB pixel electrodes respectively.

Specifically, FIG. 1 shows a configuration of an AMOLED pixel driving circuit commonly used in current market, and FIG. 2 shows a timing diagram of driving signals of the pixel driving circuit. Operation principle of the pixel driving circuit is described briefly below. The pixel driving circuit operates in three stages, wherein a first stage is a reset stage, a second stage is a data write stage, and a third stage is a light emitting stage. As an example, all transistors in the pixel driving circuit are PMOS transistors. In the first stage, a reset signal Vref is an effective signal. When the reset signal Vref is an effective signal (that is, a signal of low level as shown in FIG. 2), a transistor M1 is turned on, thereby a connected node between a capacitor C and a gate of a transistor M6 is discharged to be reset. During a period after the reset signal Vref changing from the low level to a high level and before a scanning signal Gate being effective (being in low level), the DEMUX is activated. In this period, RGB signals are inputted into RGB data lines respectively through the DEMUX, and are stored by capacitors on the RGB data lines. In the second stage, the scanning signal Gate is effective, thus transistors M3 and M2 are turned on, and thereby the signals on the RGB data lines are inputted into a source of the transistor M6, then a signal Data+Vth is written into the gate of the transistor M6 through the transistor M6, wherein Vth is a threshold voltage of the transistor M6. In the third stage, an emission signal Em is effective (being in low level), thus the transistors M4 and M5 are turned on, meanwhile the signal Data+Vth on the gate of the transistor M6 is maintained by the capacitor C, so that the transistor M6 is always in turned-on state during the light emitting stage, and emitted light compensation is achieved. It can be seen that, using such a design with a DEMUX, signal time of the scanning signal is partially occupied to write the signal Vth into the gate of the transistor M6, thus time for writing the data signal is reduced, and charging time of a pixel is reduced, thereby charging rate of the pixel is reduced, and display quality of the AMOLED product is seriously affected.

SUMMARY OF THE INVENTION

The present invention provides a pixel driving circuit and a driving method thereof, and a display apparatus, which can raise base point (starting point) for writing a data signal, ensure time for writing the data signal and avoid distortion of the written data signal.

To achieve the objective as above, following technical solutions are employed.

In an aspect of the present invention, a pixel driving circuit is provided. The pixel driving circuit comprises a reset module, a data write module, an output module and a pre-charging module, wherein the reset module is connected to a first signal input terminal, a reset voltage and a control node, and is used for resetting voltage of the control node in accordance with a signal inputted from the first signal input terminal; the data write module is connected to a gate line, a data input terminal, the control node and the output module, and is used for storing a data signal inputted from the data input terminal to the control node as a voltage when a row driving signal is inputted through the gate line, and the voltage stored at the control node is used for activating the output module; the output module is also connected to an emission signal input terminal, the control node and a light emitting device, and is used for supplying power to the light emitting device when a signal is inputted from the emission signal input terminal; the pre-charging module is connected to a second signal input terminal, the control node and the output module, and is used for pre-charging the control node after resetting is ended and before the row driving signal is inputted through the gate line.

The present invention also provides a display apparatus comprising the pixel driving circuit as above.

Further, the present invention provides a driving method of the pixel driving circuit as above. The driving method comprises: the reset module resets voltage at the control node in accordance with a signal inputted from the first signal input terminal; the pre-charging module pre-charges the control node in accordance with a signal inputted from the second signal input terminal; when a row driving signal is inputted through the gate line, the data write module stores a data signal inputted from the data input terminal to the control node as a voltage, and the voltage stored at the control node is used for activating the output module; when a signal is inputted from the emission signal input terminal, the output module supplies power to the light emitting device.

According to the pixel driving circuit and the driving method thereof, and the display apparatus provided by the invention, by pre-charging with the pre-charging module, during the period after ending of the resetting and before starting of the scanning (a period in which the DEMUX is activated), a signal is pre-written into the control node, so that after scanning starting, a data signal is started to be written in based directly on the pre-charged level, thereby a fast charging is achieved. In such manner, base point (starting point) for writing a data signal is raised, time for writing the data signal is ensured, thus charging rate of a pixel is increased, and display quality of a display apparatus is improved.

BRIEF DESCRIPTION OF THE DRAWINGS

To more clearly explain technical solutions of the present invention or the prior art, drawings required to be used in description of embodiments of the present invention or in description of the prior art will be introduced simply below. Obviously, the drawings described below are only for illustrating some embodiments of the present invention, and other drawings can be obtained according to these drawings by persons skilled in the art without any creative work. In the drawings.

DETAILED DESCRIPTION OF THE INVENTION

Figure 1:
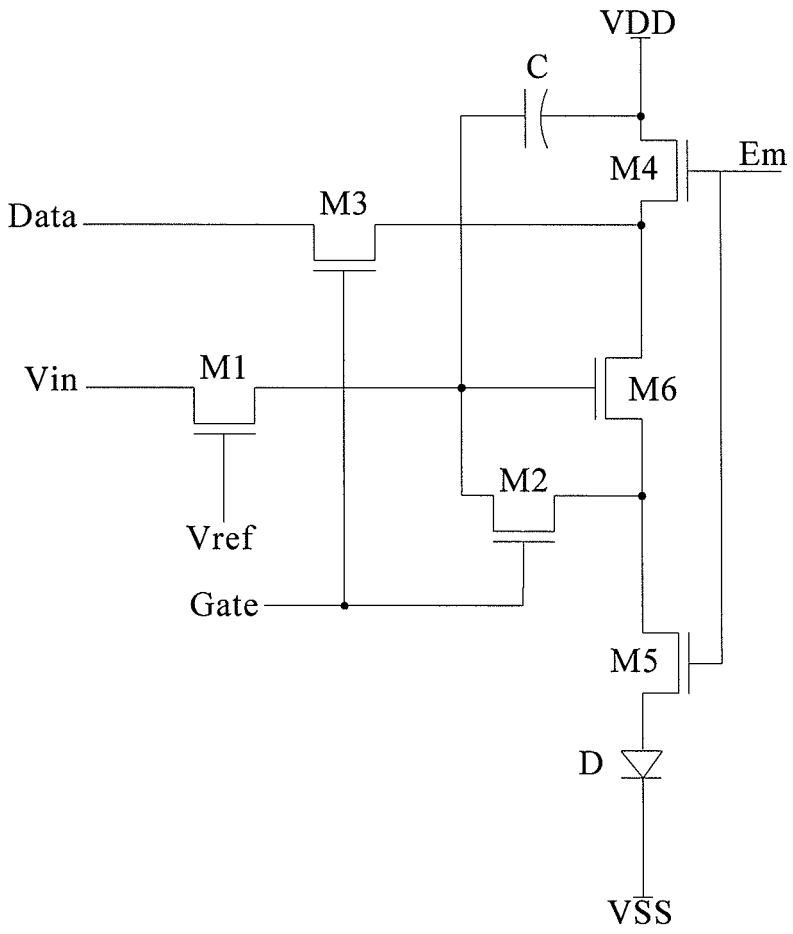
FIG. 1 is a circuit diagram of a pixel driving circuit of the prior art.

Technical solutions of the embodiments of the present invention will be described in a clear and complete manner in conjunction with the drawings. Apparently, described embodiments are only some of the embodiments of the present invention rather than all embodiments. Based on the descried embodiments, all other embodiments obtained by persons skilled in the art without creative work are intended to be encompassed by protection scope of the present invention.

Transistors used in embodiments of the present invention may be thin film transistors, field effect transistors or other devices with the same characteristics. As a source and a drain of a transistor used here are symmetrical, there is no difference therebetween. In the embodiments of the present invention, in order to distinguish other two electrodes except for a gate of a transistor, a source of a transistor is referred to as a first electrode, and a drain of a transistor is referred to as a second electrode. In accordance with the forms of the transistors in the drawings, a middle terminal of a transistor is referred to as a gate of the transistor, a signal input terminal of a transistor is referred to as a source of the transistor, and a signal output terminal of a transistor is referred to as a drain of the transistor. Further, in accordance with characteristics of transistors, transistors can be classified into N-type and P-type. In the embodiments of the present invention, as an example, all transistors are P-type transistors. A characteristic of the P-type transistor is that, when a low voltage is inputted into the gate of the transistor, the transistor is turned on. It should be understand that, it is readily conceivable to a person skilled in the art without creative work to use N-type transistors to implement embodiments of the present invention, thus embodiments in which N-type transistors are used are intended to be encompassed by protection scope of the present invention.

Figure 3:
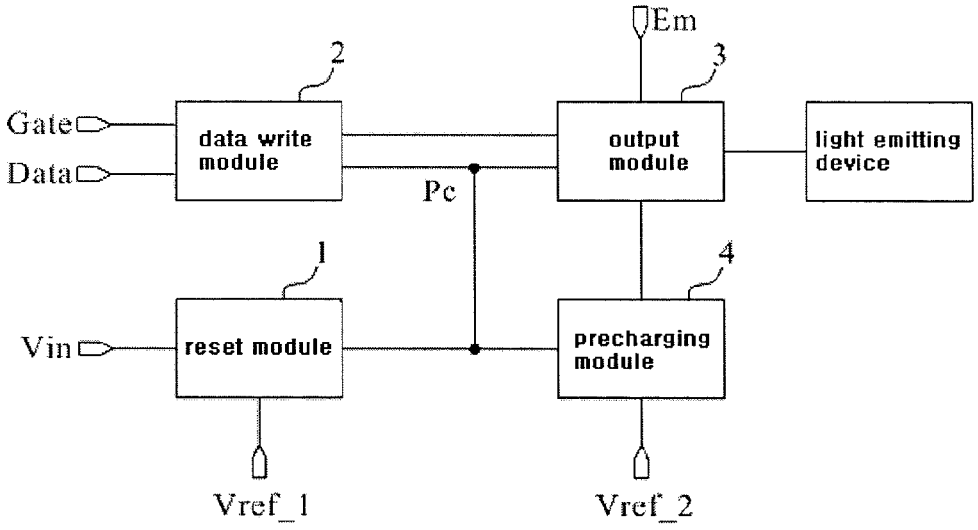
FIG. 3 is a block diagram of a pixel driving circuit according to an embodiment of the present invention.

FIG. 3 shows a pixel driving circuit according to an embodiment of the present invention. As shown in FIG. 3, the pixel driving circuit comprises a reset module 1, a data write module 2, an output module 3 and a pre-charging module 4.

The reset module 1 is connected to a first signal input terminal $Vref__1$, a reset voltage Vin and a control node Pc, and is used for resetting voltage at the control node Pc in accordance with a signal inputted from the first signal input terminal $Vref__1$.

The data write module 2 is connected to a gate line Gate, a data input terminal Data, the control node Pc and the output module 3, and is used for storing a data signal inputted from the data input terminal Data to the control node Pc as a voltage when a row driving (scanning) signal is inputted through the gate line Gate, and the voltage stored at the control node Pc is used for activating the output module 3.

The output module 3 is also connected to an emission signal input terminal Em, the control node Pc and a light emitting device D, and is used for supplying power to the light emitting device D when a signal is inputted from the emission signal input terminal Em.

The pre-charging module 4 is connected to a second signal input terminal $Vref__2$, the control node Pc and the output module 3, and is used for pre-charging the control node Pc after resetting is ended and before the row driving signal is inputted through the gate line Gate.

In the pixel driving circuit of the embodiment of the present invention, with the pre-charging module, during the period after ending of the resetting and before starting of the scanning (a period in which the DEMUX is activated), a signal is pre-written into the output module, so that after scanning is started, a data signal is started to be written in based directly on the pre-charged level, thereby a fast charging is achieved. In such manner, starting level for writing a data signal is raised, a short time for writing the data signal is ensured, thus charging rate of a pixel is increased, and display quality of a display apparatus is improved.

It should be noted that, in the embodiment of the present invention, the reset voltage Vin may be always a low voltage signal for pulling down the level of the control node Pc when the reset module 1 is activated. R, G and B signals from the DEMUX are inputted into the data input terminal Data. The light emitting device in the embodiment of the present invention may be any current driven light emitting device of the prior art such as LED or OLED.

Figure 4:
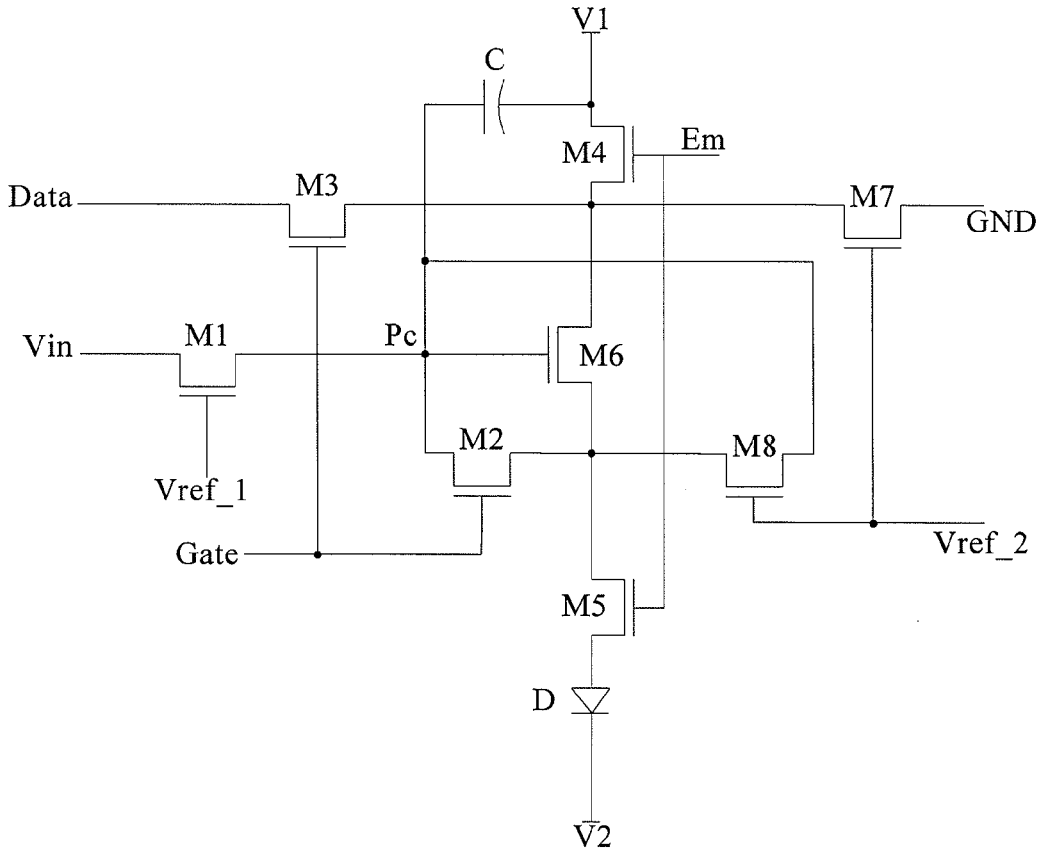
FIG. 4 is a circuit diagram of a pixel driving circuit according to an embodiment of the present invention.

Further, as shown in FIG. 4, the reset module 1 may comprises: a first transistor M1, wherein a first electrode of the first transistor M1 is connected to the reset voltage Vin, a gate of the first transistor M1 is connected to the first signal input terminal $Vref__1$, and a second electrode of the first transistor M1 is connected to the control node Pc.

In such manner, under control of the first signal input terminal $Vref__1$, the first transistor M1 is turned on, thus the reset voltage Vin is outputted to the control node Pc, thereby level of the control node Pc is pulled down, and a reset function is achieved.

Further, as shown in FIG. 4, the data write module 2 comprises: a second transistor M2, wherein a first electrode of the second transistor M2 is connected to the control node Pc, a gate of the second transistor M2 is connected to the gate line Gate, and a second electrode of the second transistor M2 is connected to the output module 3; and a third transistor M3, wherein a first electrode of the third transistor M3 is connected to the data input terminal Data, a gate of the third transistor M3 is connected to the gate line Gate, and a second electrode of the third transistor M3 is connected to the output module 3.

When a row driving signal is inputted through the gate line Gate, the transistors M2 and M3 are turned on, thus RGB signals from the data input terminal Data are inputted into the output module 3.

Further, as shown in FIG. 4, the output module 3 comprises: a fourth transistor M4, wherein a first electrode of the fourth transistor M4 is connected to a first voltage V1, a gate of the fourth transistor M4 is connected to the emission signal input terminal Em, and a second electrode of the fourth transistor M4 is connected to the second electrode of the third transistor M3; a fifth transistor M5, wherein a first electrode of the fifth transistor M5 is connected to the second electrode of the second transistor M2, a gate of the fifth transistor M5 is connected to the emission signal input terminal Em, and a second electrode of the fifth transistor M5 is connected to the light emitting device D; a sixth transistor M6, wherein a first electrode of the sixth transistor M6 is connected to the second electrode of the fourth transistor M4, a gate of the sixth transistor M6 is connected the control node Pc, and a second electrode of the sixth transistor M6 is connected to the first electrode of the fifth transistor M5; and a capacitor C, wherein one terminal of the capacitor C is connected to the first electrode of the fourth transistor M4, and the other terminal of the capacitor C is connected to the control node Pc.

In the embodiment of the present invention, an example in which P-type transistors are used is given. Here, a high voltage VDD is inputted into the first voltage terminal V1.

Specifically, when a row driving signal is inputted through the gate line Gate, RGB signals from the data input terminal Data are inputted into the first electrode of the transistor M6, then a signal Data+Vth is written into the gate of the transistor M6 via the transistor M6, wherein Vth is a threshold voltage of the transistor M6. When an effective signal is inputted into the emission signal input terminal Em, the transistors M4 and M5 are turned on, meanwhile the signal Data+Vth on the gate of the transistor M6 is maintained by the capacitor C, so that the transistor M6 is always in turned-on state during the light emitting stage of the light emitting device, and thereby emitted light compensation is achieved.

Further, as shown in FIG. 4, the pre-charging module 4 comprises: a seventh transistor M7, wherein a first electrode of the seventh transistor M7 is connected to the second electrode of the fourth transistor M4, a gate of the seventh transistor M7 is connected to the second signal input terminal $Vref_2$, and a second electrode of the seventh transistor M7 is connected to ground; a eighth transistor M8, wherein a first electrode of the eighth transistor M8 is connected to the first electrode of the fifth transistor M5, a gate of the eighth transistor M8 is connected to the second signal input $Vref_2$, and a second electrode of the eighth transistor M8 is connected to the control node Pc.

In such manner, during a period after ending of the resetting and before starting of the scanning, the DEMUX is activated, and a signal Vth is written into the gate of the transistor M6, so that after scanning starting, when a data signal Data+Vth is written in, the signal Data is written in based directly on the Vth, thus the gate of the transistor M6 is fast charged to a voltage of Data+Vth.

This configuration is obtained by the following improvement on the basis of the pixel driving circuit of the prior art: the gate and the drain of the transistor M6 are connected with each other via the transistor M8, the source of the transistor M6 is connected to one terminal of the transistor M7, and another terminal of the transistor M7 is connected to GND. As GND is the lowest signal level of the data line, distortion of the written Data+Vth is avoided, and the inputted signal Data is presented as it is.

In the pixel driving circuit as shown in FIG. 4, one terminal of the light emitting device D is connected to the second electrode of the fifth transistor M5, the other terminal of the light emitting device D is connected to a second voltage terminal V2, wherein as an example, all of the transistors are P-type transistors, and a low voltage VSS is inputted into the second voltage terminal V2.

Such configuration of the pixel driving circuit can raise base point (starting point) for writing a data signal, ensure time for writing the data signal, and avoid distortion of the written data signal, thus charging rate of a pixel is increased, and display quality of a display apparatus is improved.

Figure 5:
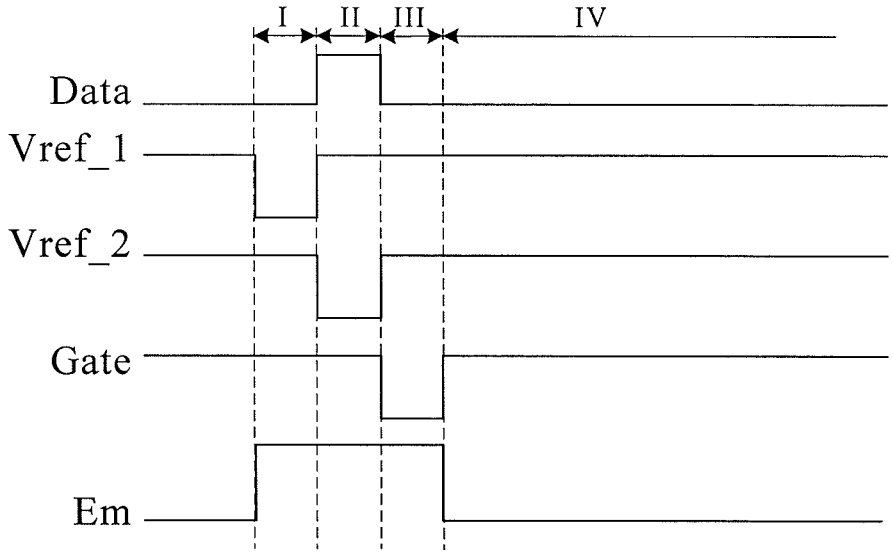
FIG. 5 is a timing diagram of driving signals of the pixel driving circuit shown in FIG. 4.

In the pixel driving circuit as shown in FIG. 4, eight P-type transistors and one capacitor C are contained, that is, this configuration may referred to as 8T1C. Thus, a relatively small number of components are used, facilitating designing and manufacturing. FIG. 5 shows a timing diagram of driving signals of the pixel driving circuit. Driving principle of the pixel driving circuit according to the embodiment of the present invention will be described in detail in a manner that the working of the pixel driving circuit is divided into four stages. In the embodiment of the present invention, a high level VDD is inputted into the first voltage signal terminal V1, and a low level VSS is inputted into the second voltage signal terminal V2.

A first stage is a reset stage. Substantially, the first stage (as shown in FIG. 2) of the pixel driving circuit as shown in FIG. 1 is divided into two parts, wherein one part corresponds to the reset stage and is considered as the first stage of the driving method of the present invention.

Figure 2:
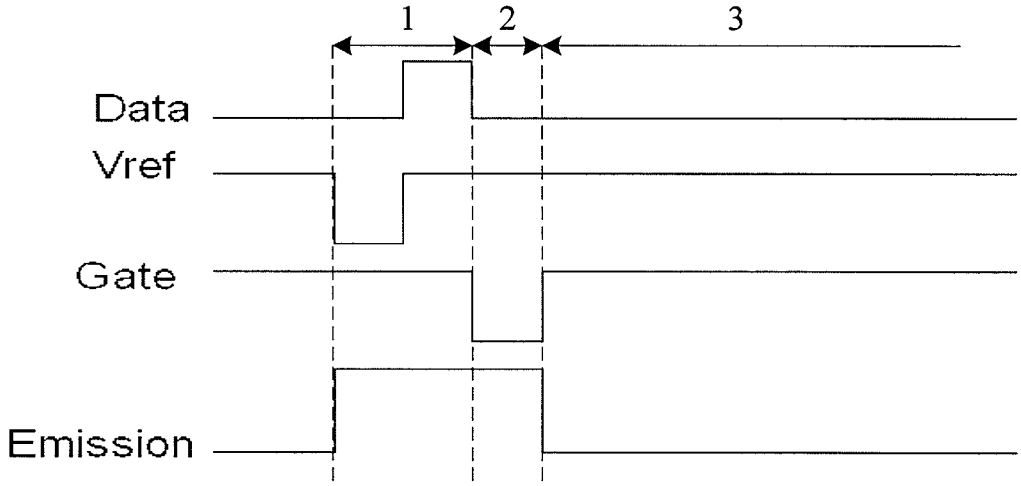
FIG. 2 is a timing diagram of driving signals of the pixel driving circuit shown in FIG. 1.

A second stage is a pre-charging stage (the other part of the first stage as shown in FIG. 2). Specifically, during a period of DEMUX after finishing the reset stage and before inputting a row driving signal through the gate line Gate, original signals of the pixel driving circuit are maintained, but an additional function of writing Vth in is added in the present invention, that is, an effective signal is inputted from the second signal input terminal $Vref_2$, so that the transistors M7 and M8 are turned on, thus a signal GND is written into the source of the transistor M6 via the transistor M7 turned on, and the gate and the drain of the transistor M6 are connected with each other via the transistor M8 turned on, thereby the transistor M6 functions as a diode. In accordance with property of a diode, both potentials of the gate and the drain of the transistor M6 become GND+Vth. As GND is the minimum voltage of a signal Data, when the signal Data is inputted, distortion of the signal written into the gate of the transistor M6 is avoided. In this manner, potential of the gate of the transistor M6 becomes GND+Vth, that is, the transistor M6 is pre-charged to a voltage of Vth.

A third stage is a data write stage, wherein when RGB signals from the data input terminal Data are written, the Data is inputted into the gate of the transistor M6 on the basis of GND+Vth. As GND is the minimum voltage of the Data, the written Data+Vth will not be distorted.

A fourth stage is an output stage. In the embodiment of the present invention, the operational principle of the third stage and the fourth stage are respectively similar to the operational principle of the second stage and the third stage of the prior art as shown in FIG. 2, which will not be explained repeatedly here.

Figure 6:
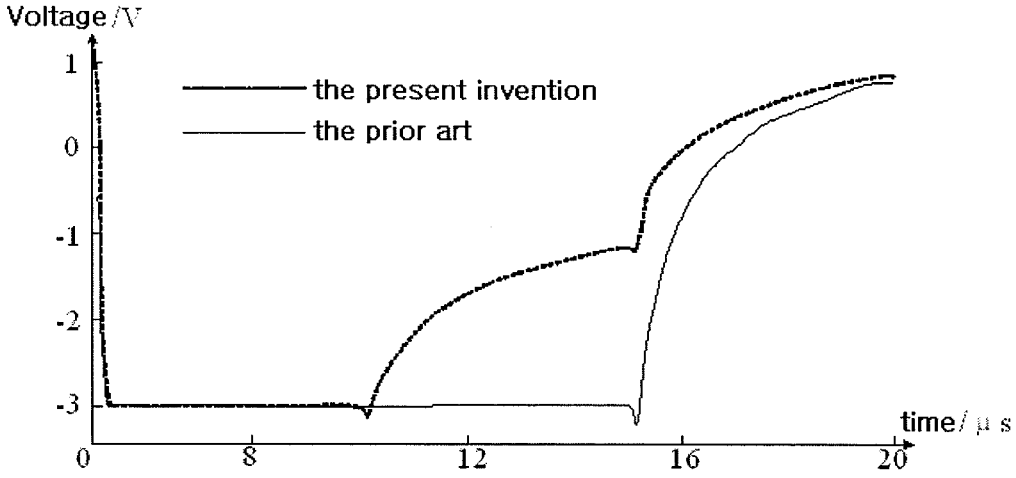
FIG. 6 is a comparative diagram of charging results between the pixel driving circuit according to an embodiment of the present invention and the pixel driving circuit of the prior art.

With the pixel driving circuit according to the embodiment of the present invention, during the period of the DEMUX after the ending of the reset stage and before the inputting of the row driving signal through the gate line, the control node Pc is pre-charged effectively, thus when the row driving signal is inputted through the gate line, the data is written in rapidly, as shown in FIG. 6. It can be seen that, due to design of pre-charging, charging speed of the pixel driving circuit according to the embodiment of the present invention is significantly faster than that of the prior art.

It should be noted that, in the pixel driving circuit according to the embodiment of the present invention, as an example, all of the transistors are P-type transistors. FIG. 5 shows a timing diagram of driving signals of the pixel driving circuit.

When all of the transistors T1 to T8 are N-type transistors, the driving signals are reversed to achieve the same function as above. The specific driving principle in this case may be referred to the descriptions of the above stages, which will not be explained repeatedly here.

Another embodiment of the present invention provides a display apparatus comprising an organic light emitting display or any other display. The display apparatus comprises the pixel driving circuit mentioned above. Further, the display apparatus may comprise a plurality of pixel units, and each pixel unit comprises the pixel driving circuit mentioned above.

Specifically, the display apparatus according to the embodiment of the present invention may be a display apparatus with a current driven light emitting device, such as a LED display or an OLED display.

The display apparatus according to the embodiment of the present invention comprises the pixel driving circuit as above. In the pixel driving circuit, by pre-charging with the pre-charging module, during the period after the ending of the reset stage and before the starting of the scanning (inputting a row driving signal), the DEMUX is activated, and a signal is pre-written into the output module, so that after starting scanning, a data signal is started to be written in based directly on the pre-charged level, thereby a fast charging is achieved. In such manner, base point (starting point) for writing a data signal is raised, time for writing the data signal is ensured, thus charging rate of a pixel is increased, and display quality of a display apparatus is significantly improved.

Figure 7:
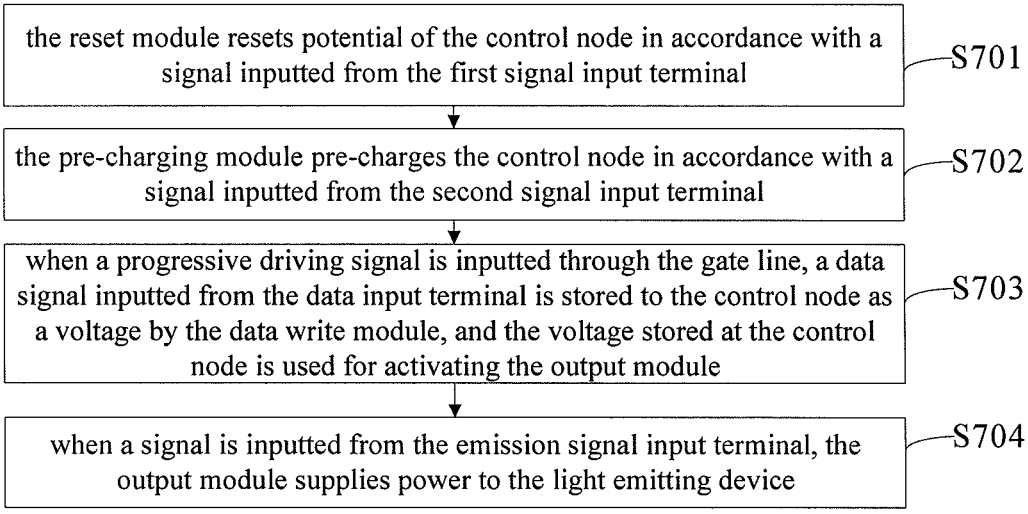
FIG. 7 is a flow chart of a driving method of an pixel driving circuit according to an embodiment of the present invention.

A driving method of a pixel driving circuit is provided in an embodiment of the present invention. The driving method may be applied to the pixel driving circuit according to the embodiment of the present invention. As shown in FIG. 7, the driving method comprises the following steps S701 to S704.

S701, the reset module resets potential of the control node in accordance with a signal inputted from the first signal input terminal.

S702, the pre-charging module pre-charges the control node in accordance with a signal inputted from the second signal input terminal.

S703, when a row driving signal is inputted through the gate line, a data signal inputted from the data input terminal is stored to the control node as a voltage by the data write module, and the voltage stored at the control node is used for activating the output module.

S704, when a signal is inputted from the emission signal input terminal, the output module supplies power to the light emitting device.

In the driving method of the pixel driving circuit according to the embodiment of the present invention, by the pre-charging step, during the period after the ending of the reset stage and before the starting of the scanning (inputting a row driving signal), the DEMUX is activated, and a signal is pre-written into the output module, so that after the starting of the scanning, a data signal is started to be written in based directly on the pre-charged level, thereby a fast charging is achieved. In such manner, base point (starting point) for writing a data signal is raised, time for writing the data signal is ensured, thus charging rate of a pixel is increased, and display quality of a display apparatus is significantly improved.

It should be noted that, the light emitting device in the embodiment of the present invention may be any current driven light emitting device of the prior art, such as LED or OLED.

In the embodiment of the present invention, all of the transistors may be P-type transistors or N-type transistors.

When the transistors are P-type transistors, a first electrode of each transistor is a source of the transistor, and a second electrode of each transistor is a drain of the transistor.

Further, when the transistors are P-type transistors, as shown in FIG. 5, timing of the control signals comprises the following stages.

In a first stage, a low level is inputted into the data input terminal Data and the first signal input terminal $Vref_1$, and a high level is inputted into the gate line Gate, the second signal input terminal $Vref_2$ and the emission signal input terminal Em.

In a second stage, a low level is inputted into the second signal input terminal $Vref_2$, and a high level is inputted into the data input terminal Data, the first signal input terminal $Vref_1$, the gate line Gate and the emission signal input terminal Em.

In a third stage, a low level is inputted into the data input terminal Data and the gate line Gate, and a high level is inputted into the first signal input terminal $Vref_1$, the second signal input terminal $Vref_2$ and the emission signal input terminal Em.

In a fourth stage, a low level is inputted into the data input terminal Data and the emission signal input terminal Em, and a high level is inputted into the first signal input terminal $Vref_1$, the second signal input terminal $Vref_2$ and the gate line Gate.

With the driving method of the pixel driving circuit according to the embodiment of the present invention, during the period after the ending of the reset stage and before the starting of the scanning (inputting a row driving signal), the DEMUX is activated, and the control node is pre-charged effectively, so that after the starting of the scanning, a data signal is rapidly written into the control node. As shown in FIG. 6, it can be seen that, in the driving method of the pixel driving circuit according to the embodiment of the present invention, due to the step of pre-charging, the charging speed is greatly faster than that of the prior art.

It should be noted that, in the driving method of the pixel driving circuit according to the embodiment of the present invention, as an example, all of the transistors in the pixel driving circuit are P-type transistors, and FIG. 5 shows the timing diagram of the driving signals in the driving method of the pixel driving circuit.

When all of the transistors in the pixel driving circuit are N-type transistors, the driving signals are reversed to achieve the same function as above. The specific driving principle in this case may be referred to the descriptions of the above stages, which will not be explained repeatedly here.

Skilled persons in the art should understand that, all or part of the embodiments described above may be implemented by hardware related to computer program, and the computer program may be stored in a computer readable storage medium such as ROM, RAM, magnetic disk, optical disk, or any other medium capable of storing the computer program, wherein when the computer program is executed, a method comprising steps of the embodiments described above is performed.

Only some specific embodiments of the present invention are described above, but protection scope of the present invention is not limited thereto. Any alteration or substitution that is readily conceivable to those skilled in the art within technical scope of disclosure of the present invention is intended to be encompassed by protection scope of the present invention. Protection scope of the claims should prevail over protection scope of the present invention.

The invention claimed is:

1. A pixel driving circuit, characterized in that, it comprises a reset module, a data write module, an output module and a pre-charging module, wherein the reset module is connected to a first signal input terminal, a reset voltage and a control node, and is used for resetting potential of the control node in accordance with a signal inputted from the first signal input terminal, the data write module is connected to a gate line, a data input terminal, the control node and the output module, and is used for storing a data signal inputted from the data input terminal to the control node as a voltage when a row driving signal is inputted through the gate line, and the voltage stored at the control node is used for activating the output module, the output module is also connected to an emission signal input terminal, the control node and a light emitting device, and is used for supplying power to the light emitting device when a signal is inputted from the emission signal input terminal, the pre-charging module is connected to a second signal input terminal, the control node and the output module, and is used for pre-charging the control node after resetting is ended and before the row driving signal is inputted through the gate line.

2. The pixel driving circuit of claim 1, characterized in that, the reset module comprises:

a first transistor, wherein a first electrode of the first transistor is connected to the reset voltage, a gate of the first transistor is connected to the first signal input terminal, and a second electrode of the first transistor is connected to the control node.

3. The pixel driving circuit of claim 2, characterized in that, the data write module comprises:

a second transistor, wherein a first electrode of the second transistor is connected to the control node, a gate of the second transistor is connected to the gate line, and a second electrode of the second transistor is connected to the output module; and a third transistor, wherein a first electrode of the third transistor is connected to the data input terminal, a gate of the third transistor is connected to the gate line, and a second electrode of the third transistor is connected to the output module.

4. The pixel driving circuit of claim 3, characterized in that, the output module comprises:

a fourth transistor, wherein a first electrode of the fourth transistor is connected to a first voltage terminal, a gate of the fourth transistor is connected to the emission signal input terminal, and a second electrode of the fourth transistor is connected to the second electrode of the third transistor;

a fifth transistor, wherein a first electrode of the fifth transistor is connected to the second electrode of the second transistor, a gate of the fifth transistor is connected to the emission signal input terminal, and a second electrode of the fifth transistor is connected to the light emitting device;

a sixth transistor, wherein a first electrode of the sixth transistor is connected to the second electrode of the fourth transistor, a gate of the sixth transistor is connected the control node, and a second electrode of the sixth transistor is connected to the first electrode of the fifth transistor; and a capacitor, wherein one terminal of the capacitor is connected to the first electrode of the fourth transistor, and the other terminal of the capacitor is connected to the control node.

5. The pixel driving circuit of claim 4, characterized in that, the pre-charging module comprises:

a seventh transistor, wherein a first electrode of the seventh transistor is connected to the second electrode of the fourth transistor, a gate of the seventh transistor is connected to the second signal input terminal, and a second electrode of the seventh transistor is connected to ground;

a eighth transistor, wherein a first electrode of the eighth transistor is connected to the first electrode of the fifth transistor, a gate of the eighth transistor is connected to the second signal input, and a second electrode of the eighth transistor is connected to the control node.

6. The pixel driving circuit of claim 4, characterized in that, one terminal of the light emitting device is connected to the second electrode of the fifth transistor, the other terminal of the light emitting device is connected to a second voltage terminal.

7. The pixel driving circuit of claim 5, characterized in that, all of the transistors are P-type transistors or N-type transistors, When the transistors are P-type transistors, the first electrode of each transistor is a source of the transistor, and the second electrode of each transistor is a drain of the transistor.

8. A display apparatus, characterized in that, it comprises the pixel driving circuit of claim 1.

9. A driving method of the pixel driving circuit of claim 1, characterized in that, it comprises:

the reset module resets potential of the control node in accordance with a signal inputted from the first signal input terminal, the pre-charging module pre-charges the control node in accordance with a signal inputted from the second signal input terminal, when a row driving signal is inputted through the gate line, a data signal inputted from the data input terminal is stored to the control node as a voltage by the data write module, and the voltage stored at the control node is used for activating the output module, and when a signal is inputted from the emission signal input terminal, the output module supplies power to the light emitting device.

10. The driving method of claim 9, characterized in that, when all of the transistors in the pixel driving circuit are P-type transistors, drive timing of the driving method comprises:

a first stage, in which a low level is inputted into the data input terminal and the first signal input terminal, and a high level is inputted into the gate line, the second signal input terminal and the emission signal input terminal, a second stage, in which a low level is inputted into the second signal input terminal, and a high level is inputted into the data input terminal, the first signal input terminal, the gate line Gate and the emission signal input terminal, a third stage, in which a low level is inputted into the data input terminal and the gate line, and a high level is inputted into the first signal input terminal, the second signal input terminal and the emission signal input terminal, a fourth stage, in which a low level is inputted into the data input terminal and the emission signal input terminal, and a high level is inputted into the first signal input terminal, the second signal input terminal and the gate line.

* * * * *